US005146860A

United States Patent [19]

Niwa et al.

[11] Patent Number: 5,146,860

[45] Date of Patent: Sep. 15, 1992

[54] SEWING AND STACKING APPARATUS

[75] Inventors: Katsuhiro Niwa, Hyogo; Tsuguhiro Shimoyama, Miyazu; Katsumi Tabushi, Miyazu; Toshio Anazawa, Miyazu, all of Japan

[73] Assignee: Gunze Limited, Kyoto, Japan

[21] Appl. No.: 687,505

[22] Filed: Apr. 19, 1991

[30] Foreign Application Priority Data

Oct. 19, 1990 [JP] Japan ..... 2-109982[U]

[51] Int. Cl.[5] ..... D05B 33/00; D05B 27/00; D05B 37/04

[52] U.S. Cl. ..... 112/121.27; 112/121.29; 112/304; 112/152; 112/130

[58] Field of Search ..... 112/121.27, 121.29, 112/304, 163, 152, 147, 130, 288, 287, DIG. 1, DIG. 2, 10

[56] References Cited

U.S. PATENT DOCUMENTS

| | | | |
|---|---|---|---|
| 2,685,664 | 8/1954 | Visconti | 112/130 X |
| 3,476,003 | 11/1969 | Adams | 112/130 X |
| 3,685,471 | 8/1972 | Reynolds | 112/121.29 |
| 3,780,682 | 12/1973 | Frost | 112/121.27 X |
| 3,871,309 | 3/1975 | Frost | 112/130 X |
| 3,973,506 | 8/1976 | Rinehimer | 112/130 |
| 4,127,075 | 11/1978 | Adamski, Jr. et al. | 112/DIG. 1 X |
| 4,214,541 | 7/1980 | Zeigler, Jr. et al. | 112/287 X |
| 4,594,955 | 6/1986 | Lichtenberg | 112/304 X |
| 4,949,658 | 8/1990 | Kobayashi | 112/121.27 X |

FOREIGN PATENT DOCUMENTS 1308701 10/1962 France .

*Primary Examiner*—Werner H. Schroeder
*Assistant Examiner*—Paul C. Lewis
*Attorney, Agent, or Firm*—Wegner, Cantor, Mueller & Player

[57] ABSTRACT

A sewing and stacking apparatus, comprising a sewing unit for stitching folded tape on a series of sewing mediums of an identical shape and size arranged appropriately apart; a transporting unit for transporting the sewing mediums having the folded tape stitched thereon; a detecting unit for detecting that one of the sewing mediums reaches a specified position; a cutting unit for cutting the folded tape at a specified point when the detecting unit detects that the above one of the sewing mediums reaches the specified position, the specified point being between the above one of the sewing mediums and another sewing medium adjacent thereto; and a stacking unit for stacking the sewing mediums separated from each other by the cutting unit.

10 Claims, 8 Drawing Sheets

SEWING AND STACKING APPARATUS

BACKGROUND OF THE INVENTION

This invention relates to a sewing and stacking apparatus for stitching a folded tape on a series of sewing mediums such as crotch panels of knitted or woven men's briefs, cutting the folded tape and stacking the sewing mediums.

As shown in FIG. 1, a men's brief comprises right and left front panels A and B, a rear panel C and a crotch panel 1. The hems of the above panels which require reinforcement, such as the hem of the crotch panel 1 defining the front slit, have a folded tape 2 stitched thereon.

As shown in FIG. 2, the folded tape 2 is stitched on upper portions of a plurality of crotch panels 1 which are arranged appropriately apart from each other. The folded tape 2 is formed by folding a lengthy cloth along two or more lines running in parallel in a longitudinal direction thereof in the manner shown in FIG. 3. In this specification, the lengthy cloth is folded along two lines into two side portions L and N and a central portion M; and the three portions are stacked in such a manner that the side portion N is interposed between the side portion L and the central portion M. Each crotch patch 1 is inserted between the side portion L and the central portion M, wherein the folded tape 2 is stitched on the crotch panel 1 with two to four pairs of threads T.

Conventionally, after the folded tape 2 is stitched on the crotch panels 1 by a conventional sewing machine as shown in FIG. 4, the folded tape 2 is cut manually and the separated crotch panels 1 are laminated one after another again manually to be assembled with the other panels A through C.

The above conventional method, by which stitching, cutting and stacking are done separately and the last two processes are left to manual work, contributes an extreme inefficiency of the whole process from stitching to stacking.

SUMMARY OF THE INVENTION

Accordingly, this invention has an object of offering a sewing and stacking apparatus for enhancing the efficiency of the procedure from stitching to stacking.

Another object of this invention is to offer a sewing and stacking apparatus for carrying out stitching, cutting and stacking automatically and continuously.

The above objects are fulfilled by a sewing and stacking apparatus, comprising a sewing unit for stitching a folded tape on a series of sewing mediums of an identical shape and size arranged appropriately apart; a transporting unit for transporting the sewing mediums having the folded tape stitched thereon; a detecting unit for detecting that one of the sewing mediums reaches a specified position; a cutting unit for cutting the folded tape at a specified point when the detecting unit detects that the above one of the sewing mediums reaches the specified position, the specified point being between the above one of the sewing mediums and another sewing medium adjacent thereto; and a stacking unit for stacking the sewing mediums separated from each other by the cutting unit.

The folded tape may be a lengthy cloth folded into two side portions and a central portion along two lines running in parallel in a longitudinal direction thereof and in the manner that one of the side portions is interposed between the other side portion and the central portion, and the folded tape may be stitched on the sewing mediums with the sewing mediums being interposed between the above two side portions.

The sewing unit may be a sewing machine having two needles.

The transporting unit may comprise a first pair of belts and a second pair of belts.

The first pair of belts may be provided along the cutting unit and the second pair of belts are provided between the first pair of belts and the stacking unit.

The above apparatus may further comprise a guiding plate provided below the cutting unit.

The cutting unit may comprise a first pair of lower and upper blades, a second pair of lower and upper blades, and a driving member for closing each pair of the blades; the first and the second pairs of blades being respectively disposed at an upstream position and a downstream position, which is a little farther from the upstream position than a length of each sewing medium in a transporting direction thereof, the lower blades of the first and the second pairs being disposed on slits of the guiding plate.

The detecting unit may comprise first and second photosensors provided on a transporting path of the sewing mediums in the vicinity of the first and the second pairs of lower and upper blades, respectively.

The first photosensor may be connected to a detecting circuit for detecting a leading end of each sewing medium, and drives the first pair of blades in accordance with the detection result of the detecting circuit; and the second photosensor is connected to a detecting circuit for detecting a rear end of each sewing medium, and drives the second pair of blades.

The second pair of belts may transport while interposing therebetween the sewing mediums which have passed through the first pair of belts and are twisted for gradually twisting 90° downward the sewing mediums.

The stacking unit may comprise a stacking table and a pivotal plate for slapping down the sewing mediums from the second pair of belts, the sewing mediums having passed therethrough, and guiding the sewing mediums onto the stacking table.

The cutting unit may further comprise a collecting unit for collecting cut-off portions of the folded tape, the collecting unit being provided in the vicinity of and downstream from the second pair of blades.

The above apparatus may further comprise a guiding unit for guiding the folded tape between the sewing unit and the guiding plate.

The above apparatus may further comprise an air blowing nozzle for blowing air to keep the sewing mediums horizontal, the nozzle being provided along the guiding unit; and an assisting plate for guiding the sewing mediums which are kept horizontal by the air blowing nozzle to the first pair of belts.

According to the present invention, sewing mediums having a folded tape stitched thereon are transported to a cutting unit by a transporting unit. When a detecting unit detects that one of the sewing mediums has reached a specified cutting position, the cutting unit cuts the folded tape at a specified point between the above one sewing medium and the adjacent sewing medium. The sewing mediums are further transported to a stacking unit by the transporting unit, wherein the sewing mediums are stacked at a specified position. Consequently, the whole process from stitching to stacking is carried out continuously with no manual labor, which contributes to a great enhancement in efficiency.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

Figure 5:
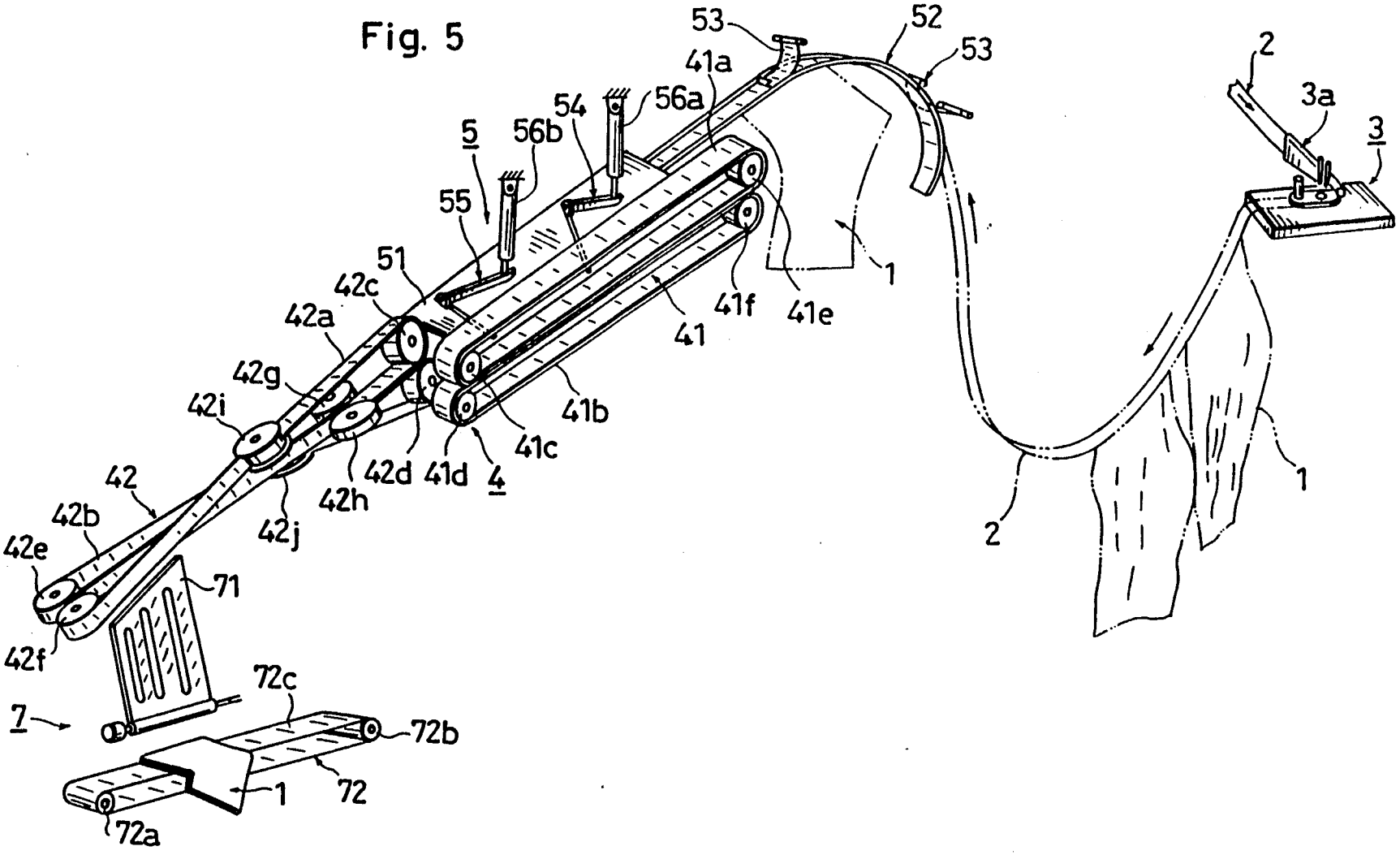
FIG. 5 is a perspective view of a sewing and stacking apparatus according to this invention.

FIG. 5 shows a perspective view of a sewing and stacking apparatus as an embodiment of this invention.

Figure 6:
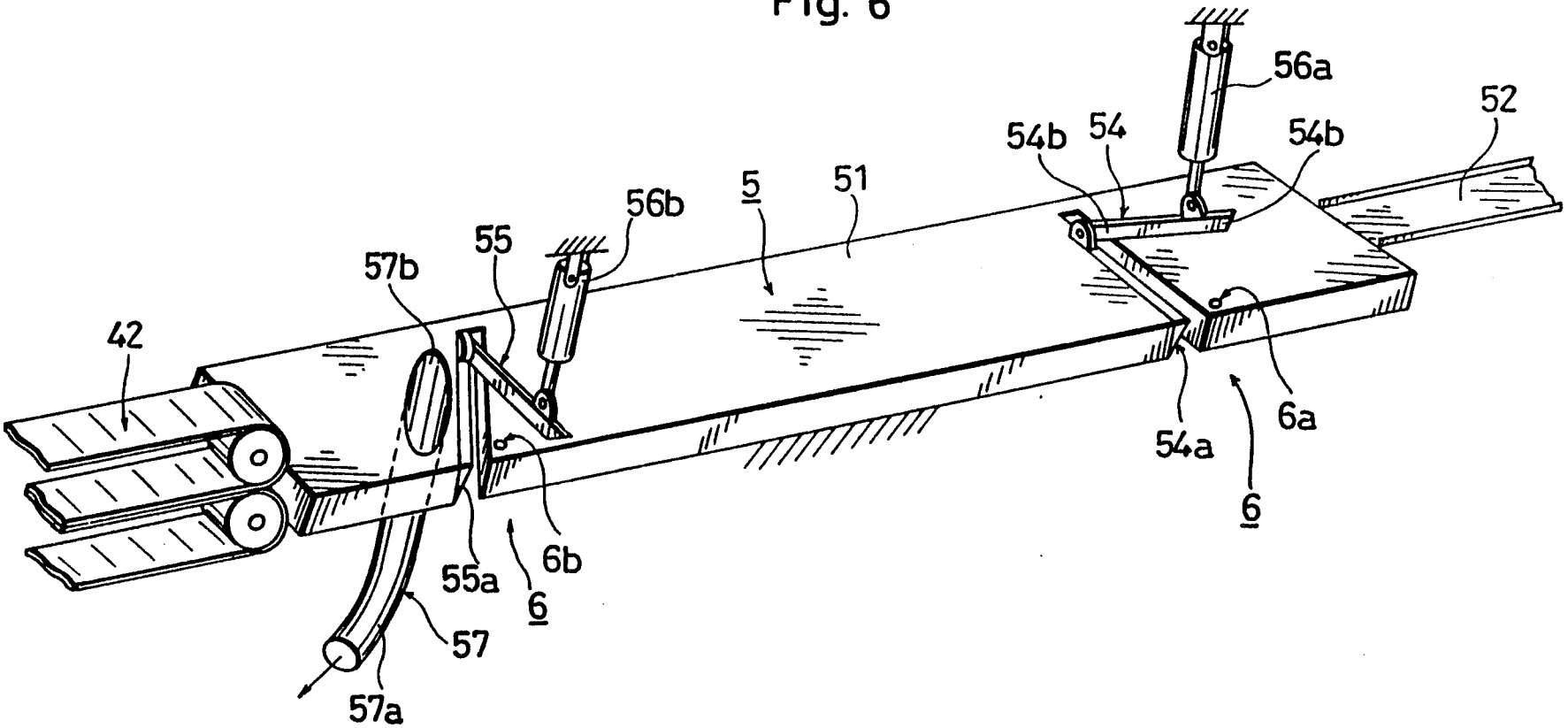
FIG. 6 is a perspective view of a cutting unit 5.

The sewing and stacking apparatus comprises a sewing machine 3 for stitching the folded tape 2 on a crotch panel 1, a cutting unit 5 for cutting off an unnecessary portion of the folded tape 2, a stacking unit 7 for stacking the crotch panels 1, a transporting unit for transporting the crotch panel 1 through the cutting unit 5 and further to the stacking unit 7, and a detecting unit 6 (FIG. 6).

Although any type of sewing machine may be employed as the sewing machine 3, it is desirable to use the one which has two, three or four needles in order to stitch strongly. In this embodiment, the sewing machine 3 has two needles for the sake of simpler figures and easier explanation.

Figure 8:
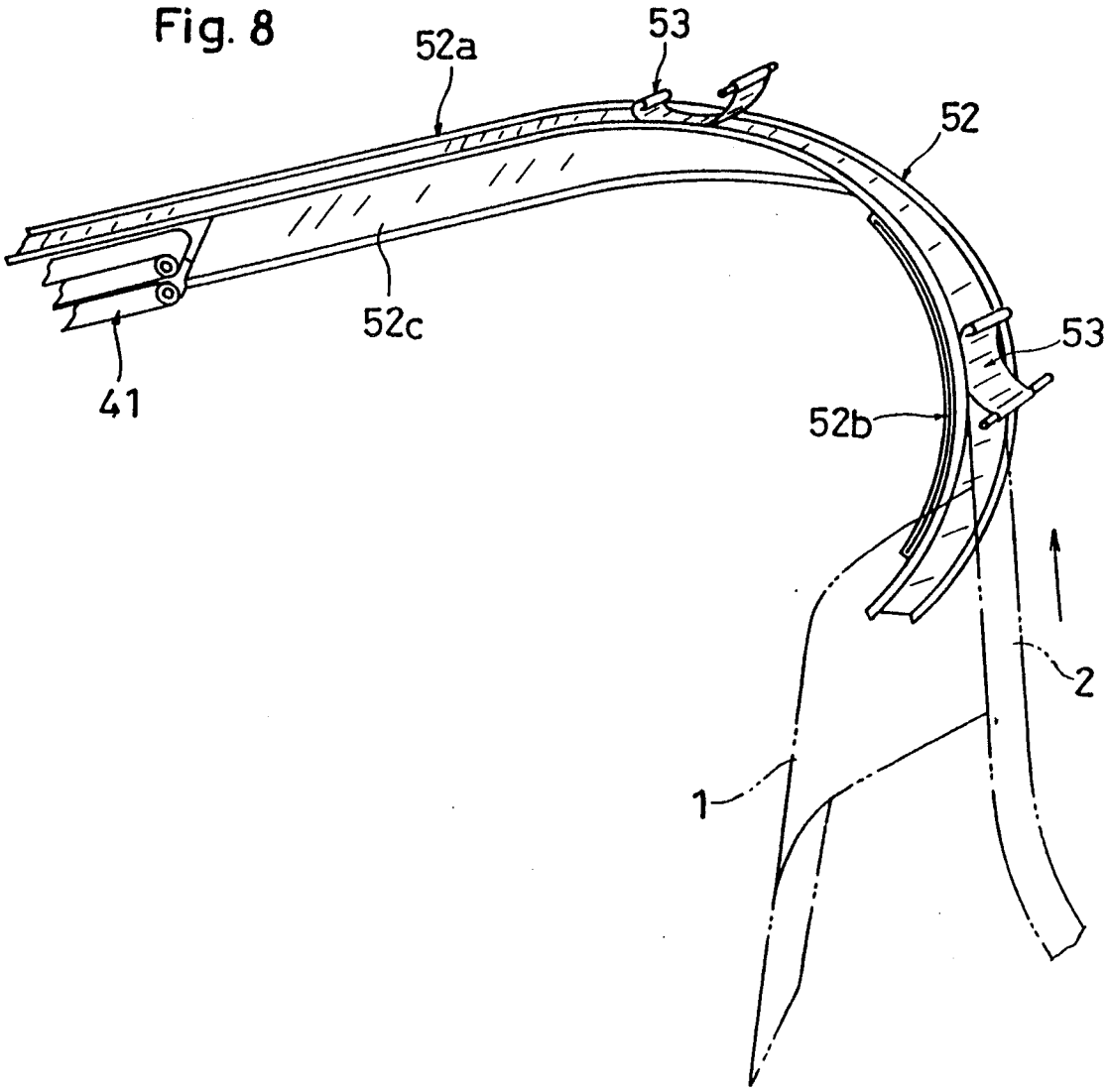
FIG. 8 is a perspective view of a guide 52 of the cutting unit 5.
Figure 7:
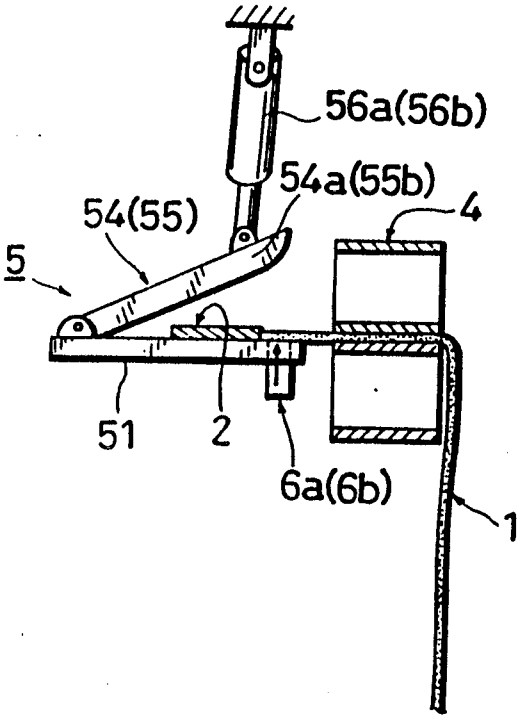
FIG. 7 is a side view of the cutting unit 5 and the vicinity thereof.

As shown in FIGS. 5, 7 and 8, the cutting unit 5 comprises a cutting table 51, a guide 52 for guiding the looped tape 2 to the cutting table 51, two cutters 54 and 55 disposed at upstream and downstream positions on the cutting table 51, and air cylinders 56*a* and 56*b* for driving the cutters 54 and 55.

Figure 9:
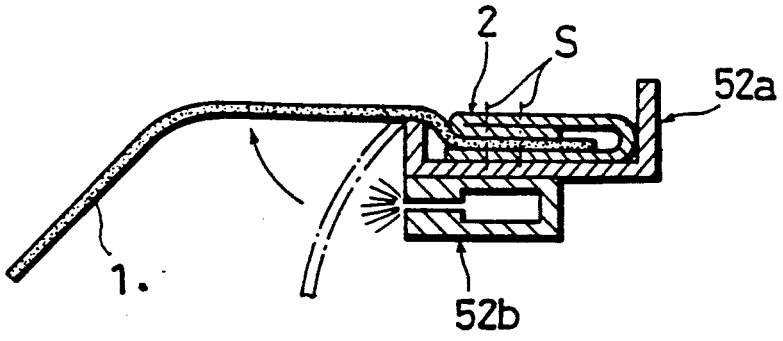
FIG. 9 is a cross sectional view of an essential part of the guide 52.

As shown in FIG. 8, the guide 52 comprises a main body 52*a* having a shallow groove-shaped cross section, at least one leaf spring 53 for pressing the tape 2 on the main body 52*a*, an air blowing nozzle 52*b* for blowing air if necessary to keep the crotch panel 1 nearly horizontal (FIG. 9), and an assisting plate 52*c* for guiding the crotch panel 1 to the transporting unit 4 keeping it horizontal.

Figure 10:
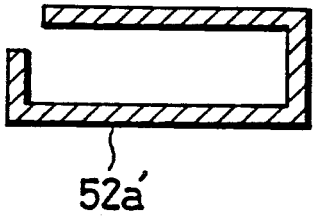
FIG. 10 is a view of a modified example of the guide 52.

The leaf spring 53 may be replaced with a roller. The main body 52*a* may have a rectangular cross section with a corner opened as indicated by 52*a*' shown in FIG. 10, in which case, the leaf spring 53 is unnecessary.

As shown in FIG. 6, the cutter 54 comprises a lower blade 54*a* and an upper blade 54*b*, and the cutter 55 comprises a lower blade 55*a* and an upper blade 55*b*. The lower blades 54*a* and 55*a* define slits of the cutting table 51, and the upper blades 54*b* and 55*b* are pivotally supported on the cutting table 51. The upper blades 54*b* and 55*b* are to be pivoted down by the air cylinders 56*a* and 56*b*, whereby to cut the looped tape 2.

Figure 11:
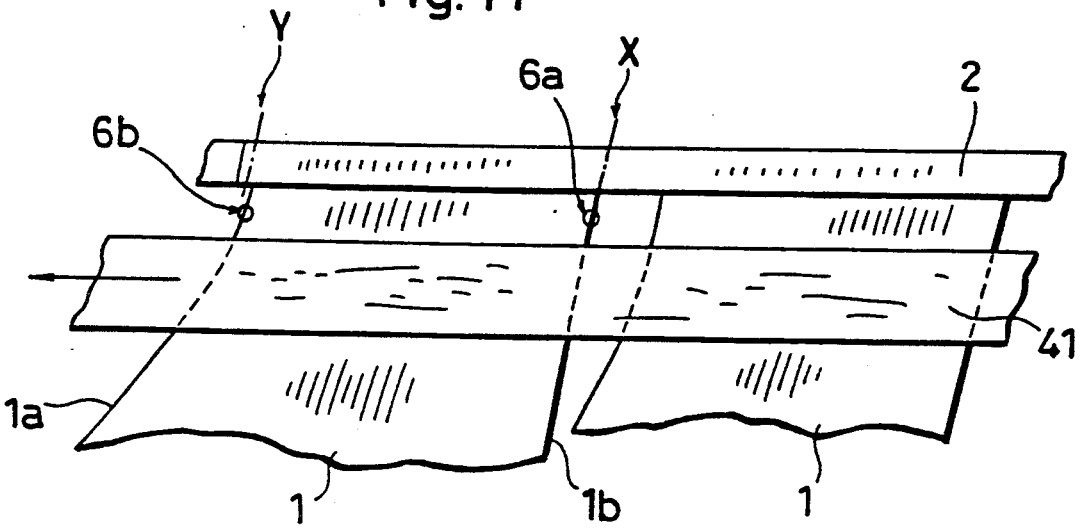
FIG. 11 is a view illustrating how the folded tape 2 is cut.

The cutting table 51 has a pair of reflective photoelectric tubes 6*a* and 6*b* buried therein in the vicinity of the cutters 54 and 55, the tubes 6*a* and 6*b* forming the detecting unit 6. As shown in FIG. 11, the cutter 54 is controlled to cut the folded tape 2 at position X in the vicinity of the rear end 1*b* of the crotch panel 1 when the rear end 1*b* is revealing the photoelectric tube 6*a* and the cutter 55 is controlled to cut the folded tape 2 at position Y in the vicinity of the leading end 1*a* of the crotch panel 1 when the leading end 1*a* is covering the photoelectric tube 1*b*.

As shown in FIG. 6, the cutting unit 5 is further equipped with a collecting unit 57 for collecting the unnecessary portion of the folded tape 2 which has been cut off by the cutters 54 and then 55. The collecting unit 57 comprises an absorbing pipe 57*a* for absorbing the cut-off portion of the folded tape 2, the pipe 57*a* being extended downward from an opening 57*b* of the cutting table 51. The pipe 57*a* is connected to a vacuum absorbing unit (not shown).

As shown in FIG. 5, the transporting unit 4 comprises a first belt unit 41 provided along the cutting table 51 and a second belt unit 42 provided downstream from the cutting table 51 in a transporting direction.

The first belt unit 41 comprises a pair of endless belts 41*a* and 41*b* which are opposed to each other on the same plane as an upper surface of the cutting table 51. The endless belt 41*a* is extended between a driving pulley 41*c* and an idle pulley 41*e* in a substantial ellipse. The endless belt 41*b* is extended between a driving pulley 41*d* and an idle pulley 41*f* in a substantial ellipse. The pulleys 41*c*, 41*d*, 41*e* and 41*f* are rotatable around axes thereof. The endless belts 41*a* and 41*b* are rotated in parallel but in opposite directions to each other at a speed substantially the same as the average sewing speed of the sewing machine 3.

Figure 12:
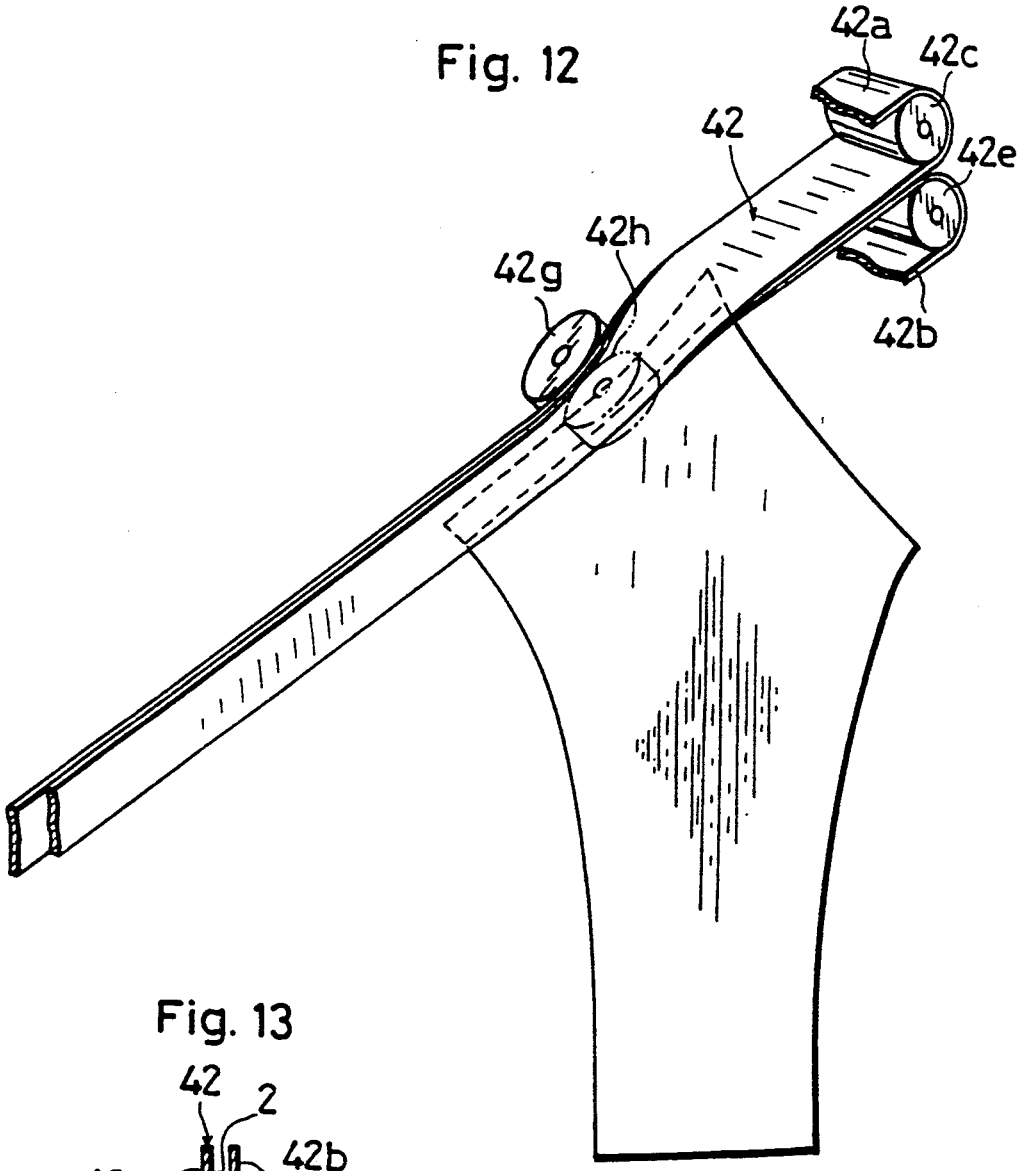
FIG. 12 is a perspective view of an essential part of the second belt unit 42.

The second belt unit 42 comprises a pair of opposing endless belts 42*a* and 42*b*. The endless belt 42*a* is extended between an idle pulley 42*c* and a driving pulley 42*f*, and the endless belt 42*b* is extended between an idle pulley 42*d* and a driving pulley 42*e*. The idle pulleys 42*c* and 42*d* are provided in the vicinity of the cutting table 51 and rotatable around horizontal axes thereof, and the driving pulleys 42*e* and 42*f* are provided downstream from the pulleys 42*c* and 42*d* and rotatable around vertical axes thereof. Guiding rollers 42*g* and 42*h* (illustrated in detail in FIG. 12) are provided a little downstream from the pulleys 42*c* and 42*d* for turning the horizontal belts 42*a* and 42*b* vertical. Guiding pulleys 42*i* and 42*j* are provided further downstream for guiding the belts 42*a* and 42*b* onto a central line of the pulleys 42*c* and 42*d*.

Figure 13:
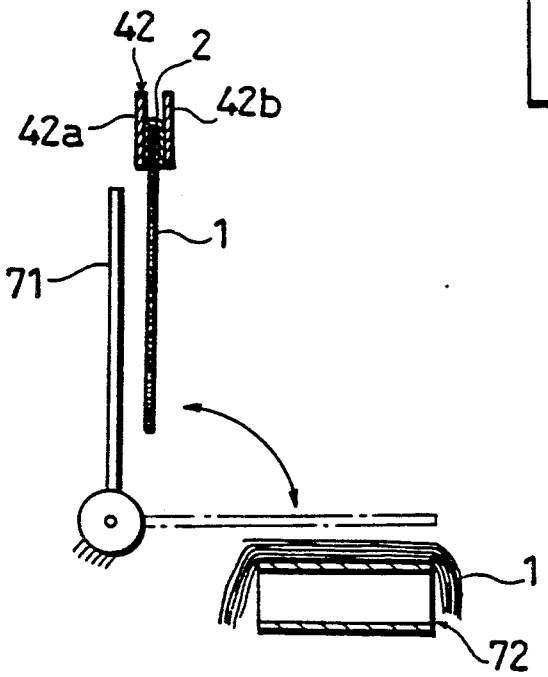
FIG. 13 is a side view of a stacking unit 7.

The stacking unit 7 comprises a pivotal plate 71 disposed below the second belt unit 42 and pivotal between a vertical position and a horizontal position (FIG. 13) and a stacking table 72 disposed below the pivotal plate 71 which is at the horizontal position. The stacking table 72 may be a simple table In this embodiment, however, the table 72 comprises a pair of pulleys 72*a* and 72*b* and an endless belt 72*c* extended in a substantial ellipse between the pulleys 72*a* and 72*b*.

The sewing and stacking apparatus having the above construction is operated in the following way.

Figure 1:
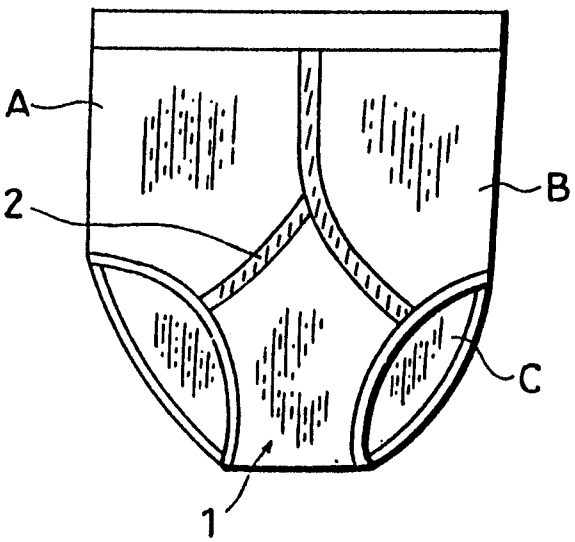
FIG. 1 is a front view of a men's brief.
Figure 2:
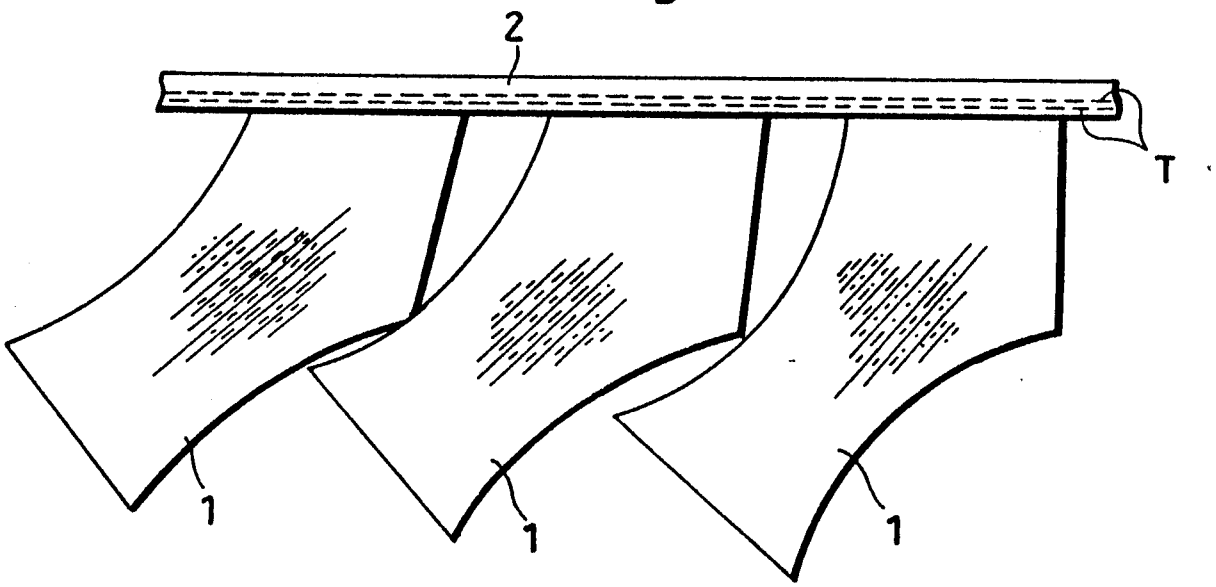
FIG. 2 is a view of the folded tape 2 stitched on a plurality of crotch panels 1.
Figure 3:
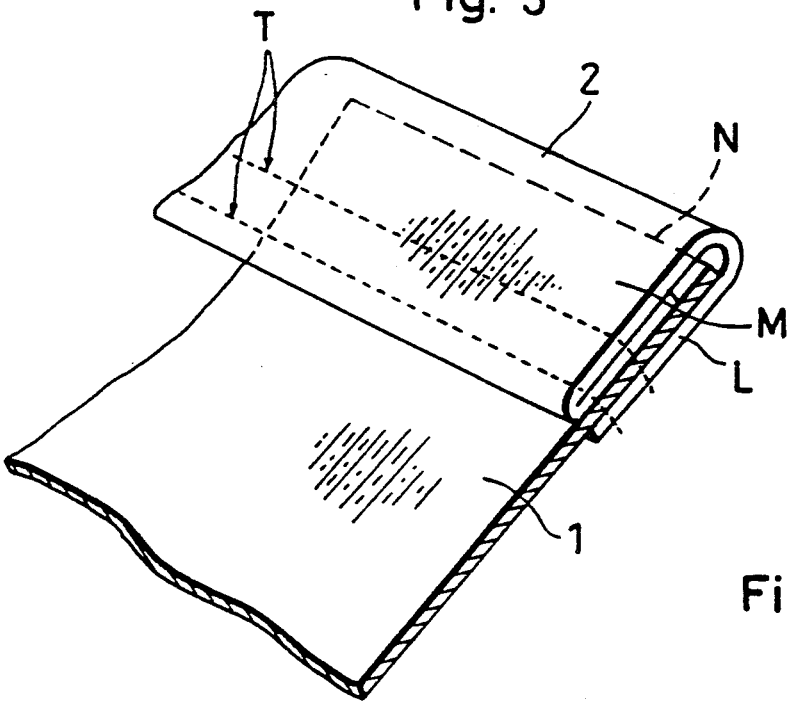
FIG. 3 is an enlarged view of a portion of the crotch panel 1 having the folded tape 2 stitched thereon.
Figure 4:
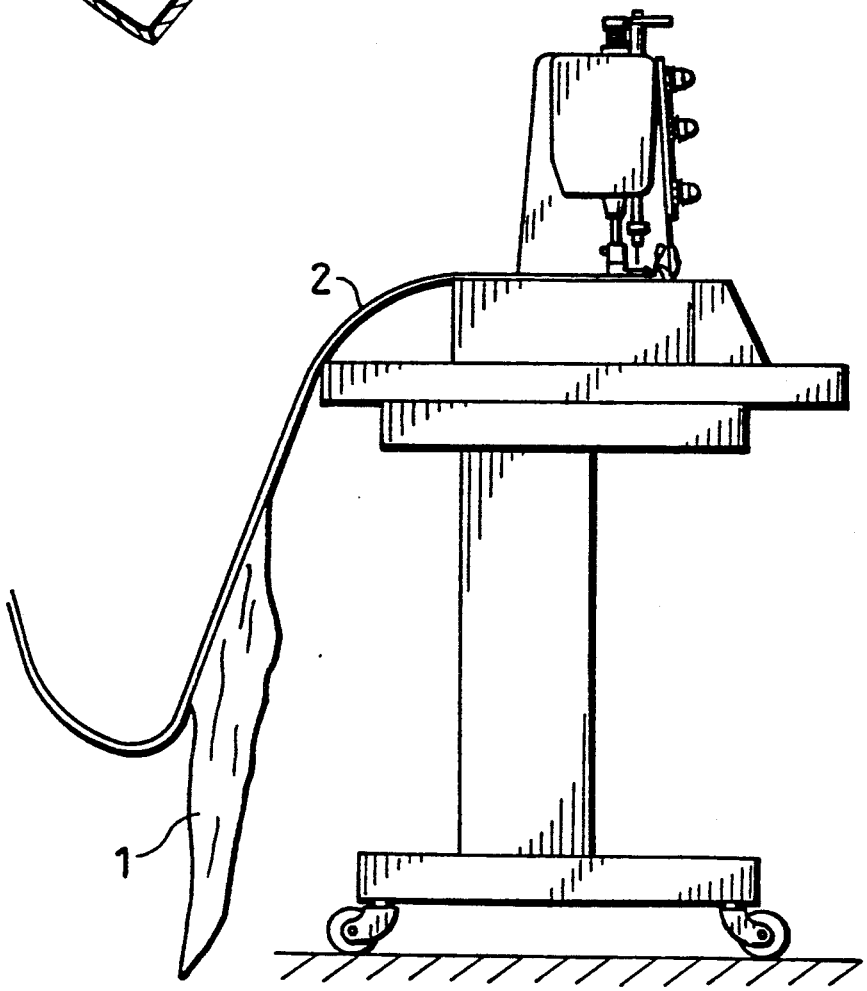
FIG. 4 is a side view of a conventional sewing machine for stitching the folded tape 2 on the crotch panel 1.

The folded tape 2 is guided below tips of needles of the sewing machine 3 by a guiding member 3*a*, wherein the folded tape 2 holds the upper portions of the crotch panels 1 (FIG. 3; in series and is stitched thereon.

Then, the folded tape 2 with the crotch panels 1 is transported to the cutting unit 5 in the following manner. The folded tape 2 is carried onto the cutting table 51 through the guide 52, and simultaneously the crotch panels 1 are transported to the first belt unit 41 in a horizontal state and interposed between the endless belts 41*a* and 41*b*. The tape 2 and the crotch panels 1 advance side by side. Before reaching the guide 52, the tape 2 is transported in a U shape so that the force of the first belt unit 41 may not influence the movement of the needles of the sewing machine 3.

When the leading end 1*a* of one of the crotch panels 1 is covering the photoelectric tube 6*b* with the rear end 1*b* of the crotch panel 1 revealing the photoelectric tube 6*a*, the cutters 54 and 55 cut the looped tape 2 at positions X and Y in the vicinity of both of the ends 1*a* and 1*b* in accordance with the principle described later. As the crotch panels 1 advance on the cutting table 51 one after another, the above cutting operation is repeated. The cut-off portions of the looped tape 2 are absorbed into the absorbing pipe 57*a*.

After that, the crotch panels 1 are carried toward the stacking unit 7 one after another with the upper portions thereof interposed between the endless belts 42*a* and 42*b*. Each crotch panel 1 is twisted 90° by the pulleys 42*g* and 42*h*, whereby the crotch panel 1 is hung vertically. When the pivotal plate 71 is pivoted down horizontally, the crotch panel 1 is released from the endless belts 42*a* and 42*b* and is slapped down flat on the laminating table 72. The crotch panels 1 are laminated on the stacking table 72 one after another with the upper portions thereof being hung downward. When a certain number of crotch panels 1 are stacked, the endless belt 72*c* is rotated, whereby another series of crotch panels 1 are stacked on another portion of the endless belt 72*c*.

Hereinafter, the principle of cutting the folded tape 2 will be described in detail.

Figure 14A:
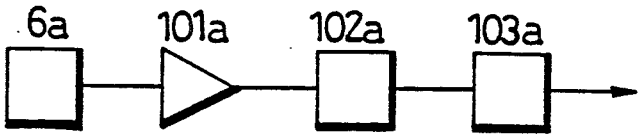
FIGS. 14*a* and 14*b* are circuit diagrams of the cutting operation.
Figure 14B:
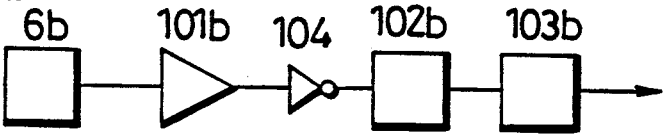

FIGS. 14*a* and 14*b* show circuits for operating the cutters 54 and 55 in accordance with the detection results of the photoelectric tubes 6*a* and 6*b*, respectively. 101*a* and 101*b* are Schmitt trigger circuits for shaping signals; 102*a* and 102*b* are one-shot multivibrators each having a specified time constant; 103*a* and 103*b* are operating valves for expanding the air cylinders 56*a* and 56*b*, respectively; and 104 is an inverter.

Figure 15A:
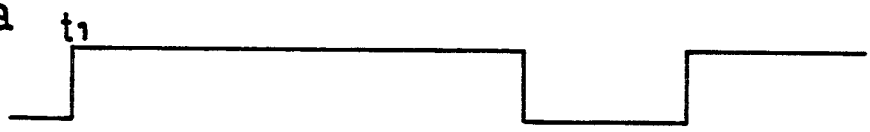
FIGS. 15*a* through 15*e* are waveforms indicating the operations of the circuits in FIGS. 14*a* and 14*b*.
Figure 15B:
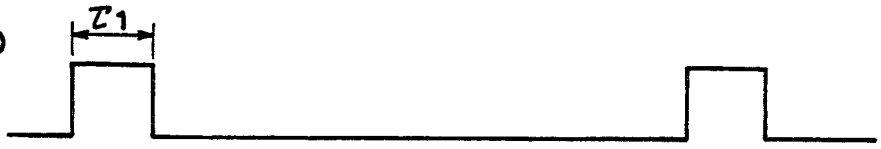
Figure 15C:
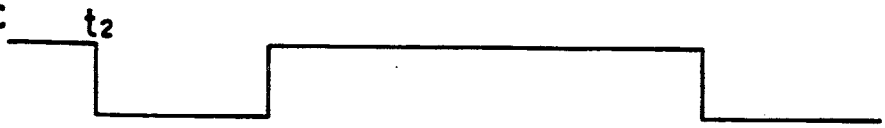

The photoelectric tubes 6*a* and 6*b*, which are of the reflective type, each output a signal when detecting the crotch panel 1 thereon. The signal from the tube 6*a* is shaped by the Schmitt trigger circuit 101*a*, and the signal from the tube 6*b* is shaped by the Schmitt trigger circuit 101*b*. Provided the Schmitt trigger circuit 101*a* has an output waveform as shown in FIG. 15*a* and that the Schmitt trigger circuit 101*b* has an output waveform as shown in FIG. 15*c*, that means the leading end 1*a* passes on the photoelectric tube 6*a* at time $t_1$ and the rear end 1*b* passes on the photoelectric tube 6*b* at time $t_2$. Since the signal from the Schmitt trigger circuit 101*a* is directly sent to the one-shot multivibrator 102*a*, the one-shot multivibrator 102*a* outputs a signal as shown in FIG. 15*b*. Accordingly, the operating valve 103*a* is operated for the duration of a time constant $t_1$ starting from time $t_1$, through which time the air cylinder 56*a* is expanded, whereby the upper blade 54*b* is pivoted down to cut the folded tape 2.

Figure 15D:
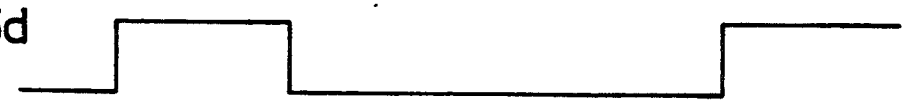
Figure 15E:
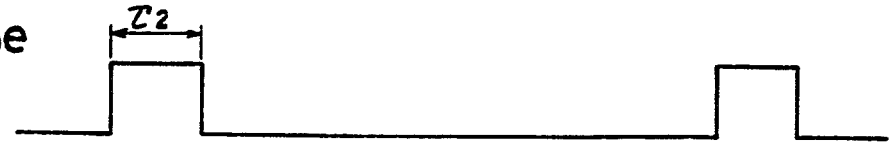

Since the signal from the Schmitt trigger 101*b* is reversed by the inverter 104 to be as shown in FIG. 15*d* before entering the one-shot multivibrator 102*b*, the one-shot multivibrator 102*b* outputs a signal as shown in FIG. 15*e*. Accordingly, the operating valve 103*b* is operated for the duration of $t_2$ starting from time $t_2$, through which time the air cylinder 56*b* is expanded, whereby the upper blade 55*b* is pivoted down to cut the folded tape 2.

According to the above construction, the folded tape 2 stitched on a series of crotch panels 1 by the sewing machine 3 is automatically transported by the first belt unit 41 to the cutting unit 5, wherein the tape 2 is cut. The tape 2 with the crotch panels 1 is further transported by the second belt unit 42 to the stacking unit 7 automatically, wherein the crotch panels 1 are stacked one after another. In this way, the whole procedure from stitching to stacking is carried out quite efficiently.

Although the crotch panel 1 is used as the sewing medium in the above embodiment, the sewing and stacking apparatus according to this invention is used for any sewing medium of any shape and any material.

Although the present invention has been fully described by way of an embodiment with references to the accompanying drawings, it is to be noted that various changes and modifications will be apparent to those skilled in the art. Therefore, unless such changes and modifications depart from the scope of the present invention, they should be construed as being included therein.

What is claimed is:

1. A sewing and stacking apparatus comprising:

sewing means for stitching a folded tape on a series of sewing mediums of a substantially identical shape and size arranged spaced apart;

transporting means for transporting the sewing mediums having the folded tape stitched thereon;

detecting means for detecting that one of the sewing mediums reaches a specified position;

cutting means for cutting the folded tape at a specified point when said detecting means detects that one of the sewing mediums reaches the specified position, the specified point being between said one of the sewing mediums and another sewing medium adjacent thereto;

a guiding plate provided below said cutting means, wherein said cutting means comprises a first pair of lower and upper blades, a second pair of lower and upper blades, and a driving member for closing each pair of the blades, the first and the second pairs of blades being respectively disposed at an upstream position and a downstream position, wherein the upstream position is further from the downstream position than a length of each sewing medium in a transporting direction thereof, the lower blades of the first and the second pairs being disposed on slits of the guiding plate;

stacking means for stacking the sewing mediums separated from each other by said cutting means;

wherein said detecting means comprises first and second photosensors provided on a transporting path of the sewing mediums in the vicinity of the first and the second pairs of lower and upper blades, respectively; and wherein the first photosensor is connected to a detecting circuit for detecting a leading end of each sewing medium, and drives the first pair of blades in accordance with the detection result of the detecting circuit, and the second photosensor is connected to a detecting circuit for detecting a rear end of each sewing medium, and drives the second pair of blades.

2. An apparatus of claim 1, wherein the folded tape is a lengthy cloth folded into two side portions and a central portion along two lines running in parallel in a longitudinal direction thereof such that one of the side portions is interposed between the other side portion and the central portion, and the folded tape is stitched on the sewing mediums with the sewing mediums being interposed between the above two side portions.

3. An apparatus of claim 2, wherein said sewing means is a sewing machine having two needles.

4. An apparats of claim 2, wherein said transporting means comprises a first pair of belts and a second pair of belts.

5. An apparatus of claim 4, wherein the first pair of belts are provided along said cutting means and the second pair of belts are provided between the first pair of belts and said stacking means.

6. A sewing and stacking apparatus comprising:

sewing means for stitching a folded tape on a series of sewing mediums of an identical shape and size arranged spaced apart;

transporting means for transporting the sewing mediums having the folded tape stitched thereon, wherein said transporting means includes a first pair of belts and a second pair of belts, the first pair of belts being provided along said cutting means and the second pair of belts being provided between the first pair of belts and the stacking means;

detecting means for detecting that one of the sewing mediums reaches a specified position;

cutting means for cutting the folded tape at a specified point when said detecting means detects that one of the sewing mediums reaches the specified position, the specified point being between said one of the sewing mediums and another sewing medium adjacent thereto;

stacking means for stacking the sewing mediums separated from each other by said cutting means; and a guiding plate provided below said cutting means;

wherein the second pair of belts transports while interposing therebetween the sewing mediums which have passed through the first pair of belts and wherein the second pair of belts are twisted 90° for gradually twisting downward the sewing mediums, and wherein the folded tape is a lengthy cloth folded into two side portions and a central portion along two lines running into parallel in a longitudinal direction thereof such that one of the side portions is interposed between the other side portion and the central portion, and the folded tape is stitched on the sewing medium with the sewing mediums being interposed between the above two side portions.

7. An apparatus of claim 6, wherein said stacking means comprises a stacking table and a pivotal plate for slapping down the sewing mediums from the second pair of belts, the sewing mediums having passed therethrough, and guiding the sewing mediums onto the stacking table.

8. An apparatus of claim 1, wherein said cutting means further comprises collecting means for collecting cut-off portions of the folded tape, the collecting means being provided in the vicinity of and downstream from the second pair of blades.

9. An apparatus of claim 1, further comprising guiding means for guiding the folded tape between said sewing means and the guiding plate.

10. An apparatus of claim 6, further comprising:

an air blowing nozzle for blowing air to keep the sewing mediums horizontal, the nozzle being provided along the guiding means; and an assisting plate for guiding the sewing mediums which are kept horizontal by the air blowing nozzle to the first pair of belts.

* * * * *